United States Patent [19]

Mori et al.

[11] Patent Number: 4,879,535

[45] Date of Patent: Nov. 7, 1989

[54] REMOTELY CONTROLLABLE CIRCUIT BREAKER

[75] Inventors: Tamotsu Mori; Makoto Yasuda, both of Shijonawate, Japan

[73] Assignee: Matsushita Electric Works, Ltd., Osaka, Japan

[21] Appl. No.: 195,054

[22] Filed: May 17, 1988

[51] Int. Cl.[4] ..... H01H 75/00

[52] U.S. Cl. ..... 335/14; 335/6; 335/20

[58] Field of Search ..... 335/6, 14, 16, 20

[56] References Cited

U.S. PATENT DOCUMENTS

| | | | |
|---|---|---|---|
| 4,456,832 | 6/1984 | Greer et al. | 335/14 |
| 4,598,263 | 7/1986 | Heyne et al. . | |
| 4,604,596 | 8/1986 | Yokoyama et al. . | |
| 4,623,859 | 11/1986 | Erickson et al. | 335/20 |
| 4,682,132 | 7/1987 | Belbel et al. | 335/14 |
| 4,700,160 | 10/1987 | Belbel et al. . | |
| 4,768,025 | 8/1988 | Vila-Masot | 335/17 |

*Primary Examiner*—H. Broome
*Assistant Examiner*—Lincoln Donovan
*Attorney, Agent, or Firm*—Armstrong, Nikaido, Marmelstein, Kubovcik & Murray

[57] ABSTRACT

An improved circuit breaker with remote control capability includes an electromagnet energized by a remote control signal to open and close a power contact through a collapsible mechanical linkage. The breaker also includes a manual handle which is mechanically isolated from the mechanical linkage interposed between the electromagnet and the power contact but is connected to a control switch for opening and closing the same when it is manipulated between an ON-position and an OFF-position. The control switch is utilized to be connected in a control circuit for the electromagnet in a suitable electrical relation with an excitation coil of the electromagnet to provide a desired load managing control mode. A fault current responsive tripper is interlocked with the mechanical linkage so as to collapse the same for opening the power contact upon the occurrance of a predetermined fault current condition, whereby the circuit interruption due to the fault current condition can be effected by directly driving the mechanical linkage and without actuating the electromagnet.

12 Claims, 12 Drawing Sheets

REMOTELY CONTROLLABLE CIRCUIT BREAKER

BACKGROUND OF THE INVENTION

1. Field of the Invention The present invention is directed to a remotely controllable circuit breaker, and more particularly to such a circuit breaker having, in addition to a manual handle for closing and opening a breaker contact, an electromagnet which responds to a remote signal for closing and opening the breaker contact.

2. Description of the Prior Art

Remotely controllable circuit breakers have been extensively utilized for load managements. One such prior breaker of general type is proposed in U.S. Pat. No. 4,529,951 in which a manual handle for opening and closing a breaker contact is directly connected to an electromagnet to be controlled thereby. Although such two-way control allows the breaker contact to be controlled for managing a load either by a remote control signal supplied to energize the electromagnet from a remote station or by a direct manipulation of the handle, it poses a potential hazard that the load may be turned on by the operation at the remote station while it is not desired at the locale station near the breaker, or the vice versa. This unintentional energization of the load should be avoided particularly when a heavy duty power load is managed for ensuring safe working environment. To overcome the above disadvantage, a breaker is demanded to have a remote control capability which can allow the breaker contact to be controlled under a desired combination of the handle and remote control operations. A contactor device disclosed in U.S. Pat. No. 4,473,860 gives a solution to the above problem, although it is not so intended. The device, in which the closing and opening of a main contact is also controlled by an electromagnet receiving a remote signal, includes a control switch which is actuated by a reset handle to be closed and opened independently of the electromagnet operation. The control switch is connected in a control circuit in series relation with the electromagnet so that the main contact can be closed only when the control switch is closed and the electromagnet is energized by a remote control signal. The device also includes an overcurrent responsive tripping mechanism which is interposed between the handle and the control switch and is released or unlatched upon a predetermined fault current condition to open the control switch and in turn deenergize the electromagnet for circuit interruption. The control switch is kept opened by the tripping mechanism until the handle is manipulated to reset the tripping mechanism. In this device, the tripped circuit interruption is made only through the deactivation of the electromagnet. In other words, the fault current responsive tripping of the main contact involves the operations of the tripping mechanism linked to the handle, the control switch, and the electromagnet. Thus, the prior device requires a complicated structure or operational linkage between a fault current sensor and the main contact, which may lower the reliability of the tripped circuit interruption. In addition to the above disadvantage, this device is further found to be inconvenient when the handle is utilized to manipulate the main contact, since the handle is interlocked with the tripping mechanism and always drags the same as the handle is manipulated between its ON-position and OFF-position. The interposition of the tripping mechanism between the handle and the control circuit is therefore likely to interfere with simple and reliable handle structure and movement.

SUMMARY OF THE INVENTION

The present invention provides an improved circuit breaker of remote control capability which eliminates the above disadvantage or insufficiency. In the circuit breaker of the present invention, power contact means for managing an electric load is mechanically coupled to a collapsible mechanical linkage so as to be actuated thereby between an open condition and a closed position. The mechanical linkage has its one end operatively connected the armature of an electromagnet and has the other end connected to fault current responsive tripper means so that it can be controlled to have the main contact kept opened either by means of the electromagnet or by the tripper means. When a predetermined fault current condition is detected, the tripper means unlatches the mechanical linkage to open the main contact without functioning the electromagnet. Thus, the main contact can be driven directly by the mechanical linkage into the open condition and kept opened by the same without requiring any intervening mechanism and control sequence therebetween, or independently of a control circuit of the electromagnet, ensuring reliable circuit interruption due to the fault current condition. The electromagnet includes excitation coil means connected in the control circuit to be energized and deenergized upon receiving a remote control signal for driving the armature between an actuated position of closing the power contact through the mechanical linkage and a rest position of opening the power contact through the same linkage. Also included in the breaker is a control switch to be actuated by a manual handle which is movable between an ON-position and an OFF-position as mechanically isolated from the mechanical linkage. The control switch is adapted to be connected in a suitable circuit relation with the excitation coil means of the electromagnet for obtaining a desired control mode for load management. For example, when the control switch is connected in series with the excitation coil means, the breaker contact can be closed only when the handle is turned into the ON-position and the excitation coil means receives from a remote station a control signal driving the armature into the actuated position.

Accordingly, it is a primary object of the present invention is to provide an improved circuit breaker with remote control capability in which the manual handle can be manipulated free from the contact driving mechanism and in which the power contact is driven directly by the contact driving mechanical linkage to be tripped into the open condition, independently of the electromagnet operation, upon a fault current condition.

In a preferred embodiment, the armature is biased by return spring means toward a rest position of opening the power contact means and is connected to drive the mechanical linkage into the actuated position of closing the power contact means in response to the energization of the excitation coil means. On the other hand, the power contact means is cooperative with release spring means to be normally open so that these two spring means exerts added spring forces in a direction of opening the power contact means, for a fail-safe breaker operation, which is therefore another object of the present invention.

The breaker of the present invention further includes an alarm switch of normally closed type which is inserted in series relation the control switch and is operatively connected to the tripper means so that it is made open to deenergize the electromagnet, simultaneously with the tripping of the mechanical linkage for circuit interruption, whereby effecting the contact opening through the use of the electromagnet, in addition to the tripping operation of the mechanical linkage. Thus, the circuit interruption can be made in a dual safe manner, which is therefore a further object of the present invention.

With the above configuration of mechanically linking or interlocking the armature of the electromagnet to the mechanical linkage, it is readily possible to reset the mechanical linkage once collapsed or unlatched back to a latched position. In view of this, the armature is linked to the mechanical linkage such that the linkage can be reset to the latched position from the collapsed position as the armature is returned from the actuated position back to the rest position by the remote control. In addition, the manual handle is provided with a reset lever which is engageable with the mechanical linkage in the collapsed position in such a way as to transmit to the linkage a restoring force of moving it back to the latched position as the handle is moved from the ON-position to OFF-position. Thus, the reset of the mechanical linkage can be done either through the electromagnet or through the handle depending on the requirement at an installation site.

It is therefore a still further object of the present invention to provide an improved circuit breaker with remote control capability in which the tripped mechanical linkage can be reset in a remotely controlled manner or by manipulating the handle.

Depending upon a particular application site, the breaker may be required to inhibit the resetting of the mechanical linkage by the remote control. In compliance with such requirement, the circuit breaker of the present invention additionally includes means for inhibiting the mechanical linkage from being reset through the electromagnet, allowing the reset only by the manipulation of the handle, which is therefore a still further object of the present invention.

The fault current responsive tripper means is cooperative with a plunger having first and second end. The plunger is electromagnetically coupled to a magnetic coil inserted in series circuit with the power contact means and is mechanically coupled to the tripper means at the second end so that it activates the tripper means for unlatching or tripping the mechanical linkage upon the coil seeing an extreme overcurrent, for example, a short-circuit current through the power contact means. The first end of the plunger is engageable directly with the power contact means without any intervening linkage therebetween in such a way that the plunger act to firstly strike said power contact means to apply a contact opening impact thereto at said first end and subsequently actuate said tripper means at said second end to unlatch said mechanical linkage into its collapsed position. Thus, an instantaneous circuit interruption can be effected by the contact opening impact directly applied to the power contact means followed by the tripping circuit interruption. These two operations is effected by a single plunger but in a lagged manner so that the plunger will not drag the tripper means at the instant of striking the power contact means, providing a maximum contact opening impact for safe and rapid circuit interruption, which is therefore a still further object of the present invention.

The power contact means comprises a fixed contact and a movable contact carried by a displaceable contact holder. The contact holder is cooperative with the release spring means to urge the movable contact away from the fixed contact and is engageable with the mechanical linkage in such a manner that the contact holder is pulled in the direction of disengaging the movable contact from the fixed contact by means of the mechanical linkage moving from the latched position to the collapsed position. With this provision, the movable contact receives contact separating forces respectively from the release spring and the mechanical linkage. This provides a safeguard in that the movable contact can be forcibly disengaged from the fixed contact even if the release spring means should fail to operate.

It is therefore a still further object of the present invention to provide an improved remotely controllable circuit breaker in which the fault current responsive circuit interruption can be effected in a reliable and safety manner.

These and still other objects and advantages of the present invention will become apparent from the following description of the embodiment of the present invention when taken in conjunction with the attached drawings.

DESCRIPTION OF THE EMBODIMENT

Figure 1:
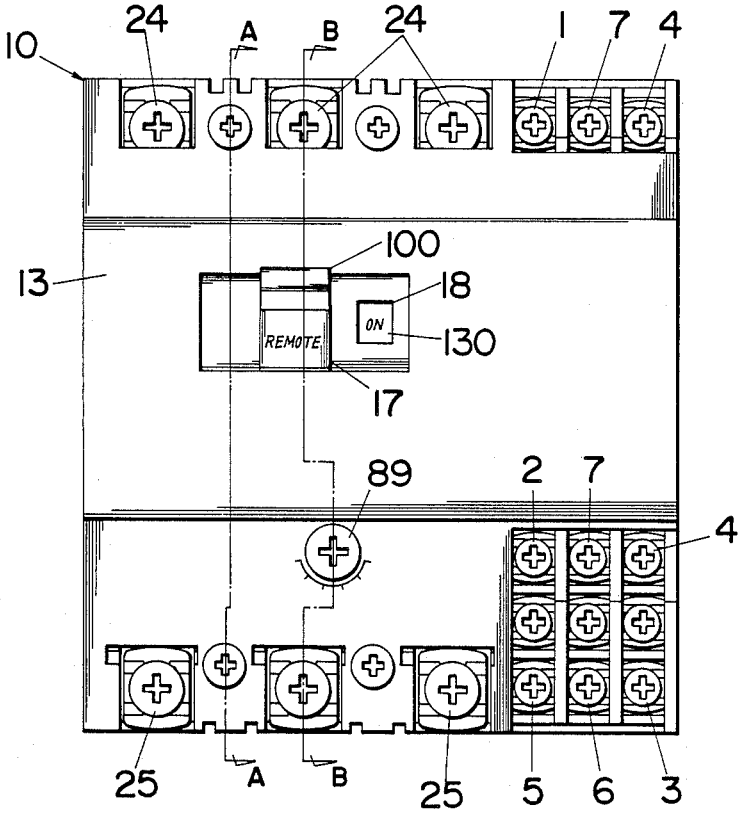
FIG. 1 is a top view of a circuit breaker in accordance with a preferred embodiment of the present invention.
Figure 2A:
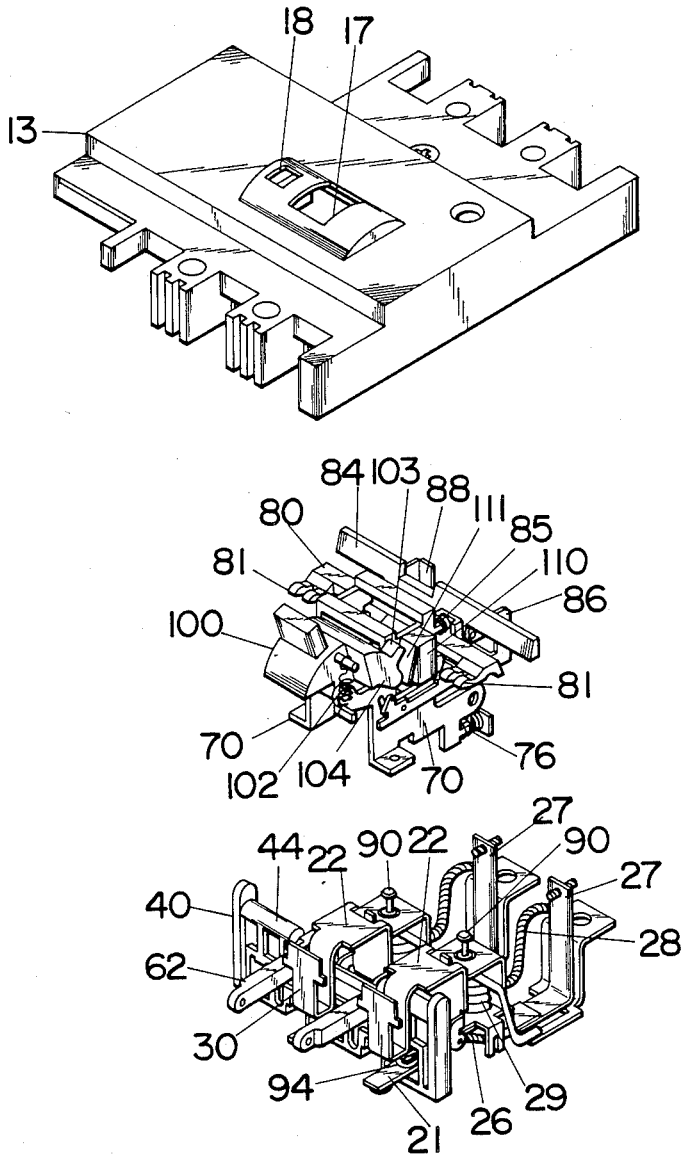
FIG. 2, composed of FIGS. 2A and 2B, is an exploded perspective view of the breaker.
Figure 2B:
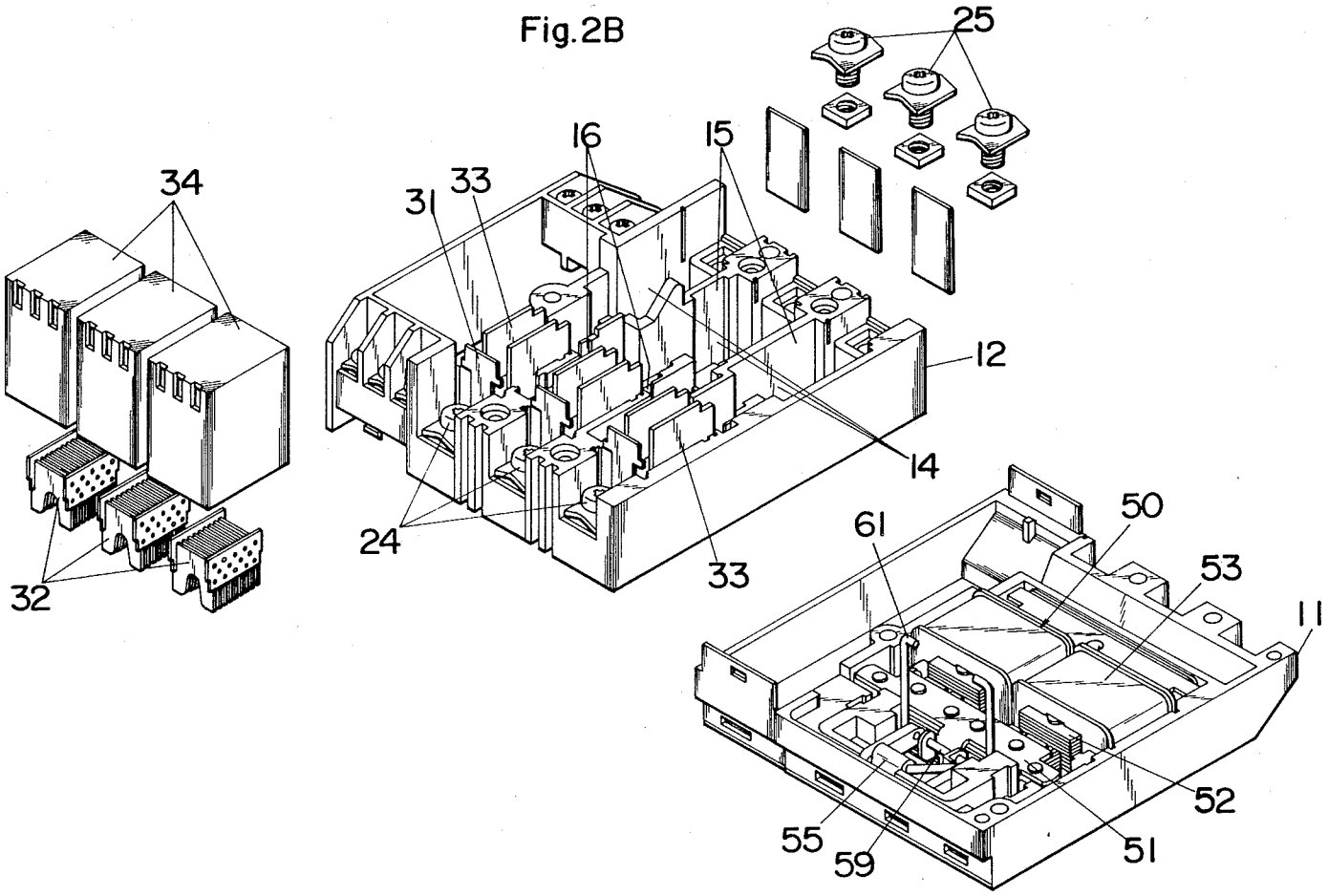
Figure 3A:
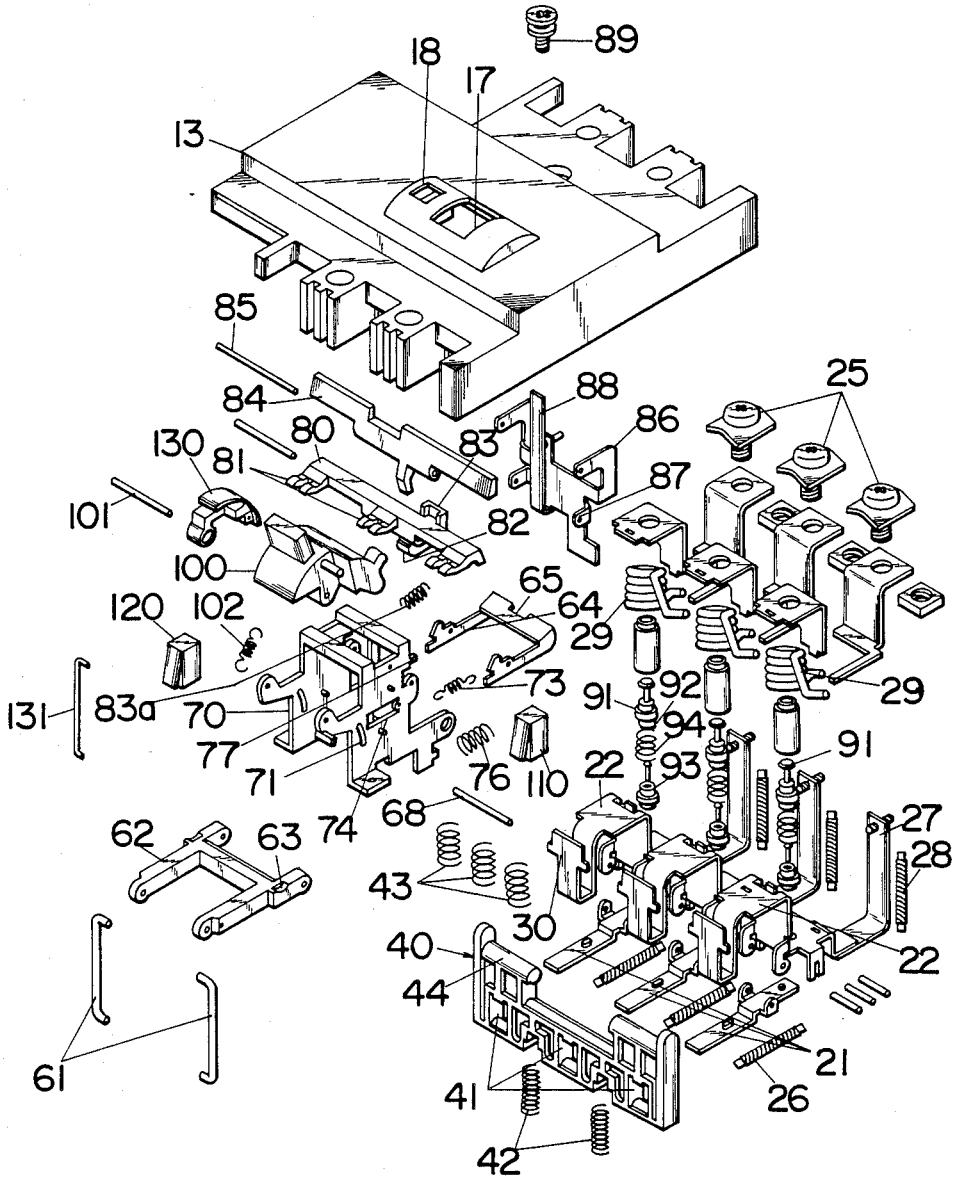
FIG. 3, composed of FIGS. 3A and 3B, is a further exploded perspective view of the breaker.
Figure 3B:
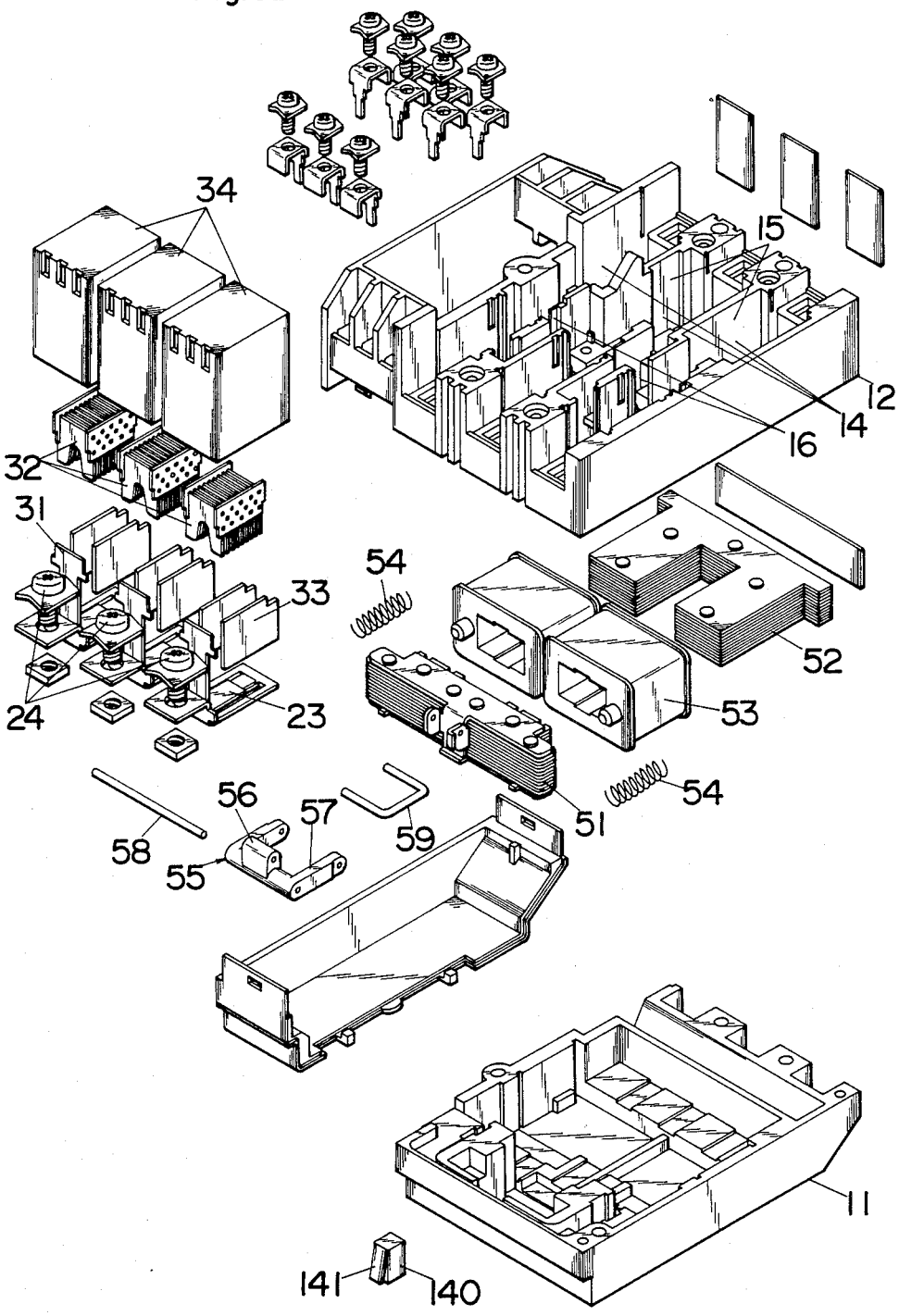

Referring now to FIGS. 1 to 3, a remotely controllable circuit breaker in accordance with the present invention is provided as a three-pole circuit breaker having a power contact set 20 in each pole, a single electromagnet 50 responsible for a remote control operation, and a manual handle 100. These members are accommodating together with associated parts in a breaker housing 10 composed of a lower casing 11, an upper casing 12, and a cover plate 13. As shown in FIGS. 2, 3, and 8 to 11, the power contact set 20 in each pole comprises a movable contact arm 21 pivotally supported at its intermediate portion to a member 22 and a fixed contact 23 extending integrally from a line terminal 24. The movable contact arm 21 has its end connected to a load terminal 25 via a first braid 26, a bimetallic strip 27, a second braid 28, and a magnetic coil 29. The line and load terminals 24 and 25 are disposed on the opposite sides of the upper casing 12 of the breaker housing 10.

The power contact set 20 and the associated parts in each pole are accommodated in each of elongated pole chambers 14 separated by upright partitions 15 within the upper casing 12. Each of the members 22 carrying the movable contact arm 21 is formed integrally with an U-shaped horn 30 which extends above the movable contact arm 21. A complementary horn 31 extends upwardly from each of the line terminals 24 in an opposed relation with the U-shaped horn 30 and receives therebetween a stack of arc-shearing plates 32 for rapid and effective extinguishment of a possible arc developing at the time of contact separation between the movable contact 21 and the fixed contact 23. Each stack of the arc-shearing plates 32 is held between a pair of insulation pieces 33 received in each of said pole chamber 14 and is further received within a shield 34 for electrically isolating the stacks as well as the fixed contact 23 and the corresponding portion of the movable contact arm 21 from pole to pole. In this connection, each pole chamber 14 is separated from the electromagnet 50 in the lower casing 11 by a bottom wall **12*a* of the upper casing 12 which, extends horizontally, as shown in FIG. 8, from the portion over the fixed contact 23 to the portion over the movable contact 21 so as to entirely separate the full length of each power contact 20 from the electromagnet 50**.

Figure 4:
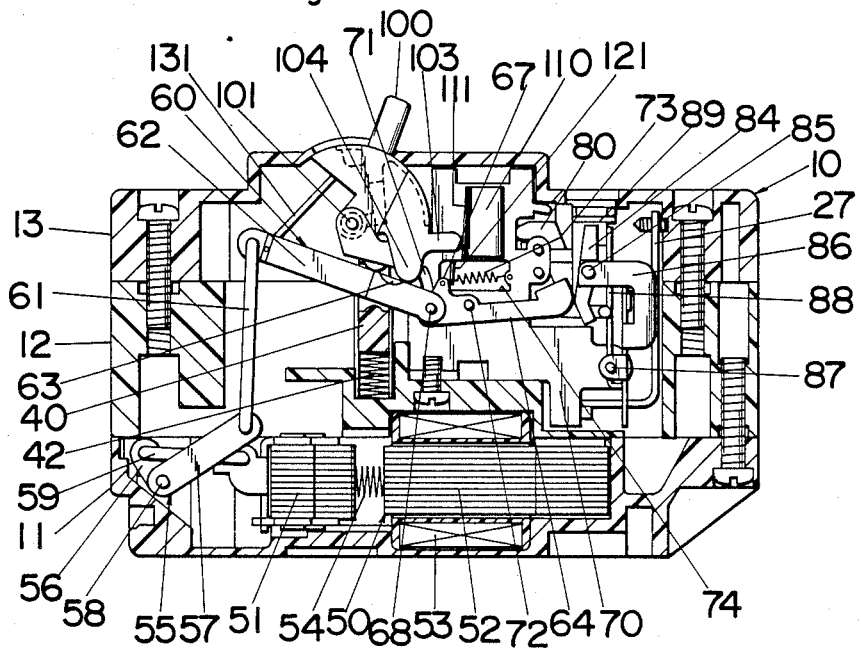
FIGS. 4 to 7 are sectional views taken along line A-A of FIG. 1, respectively showing the breaker in a manually OFF position, a remotely OFF position, an ON position, and a tripped OFF position.
Figure 8:
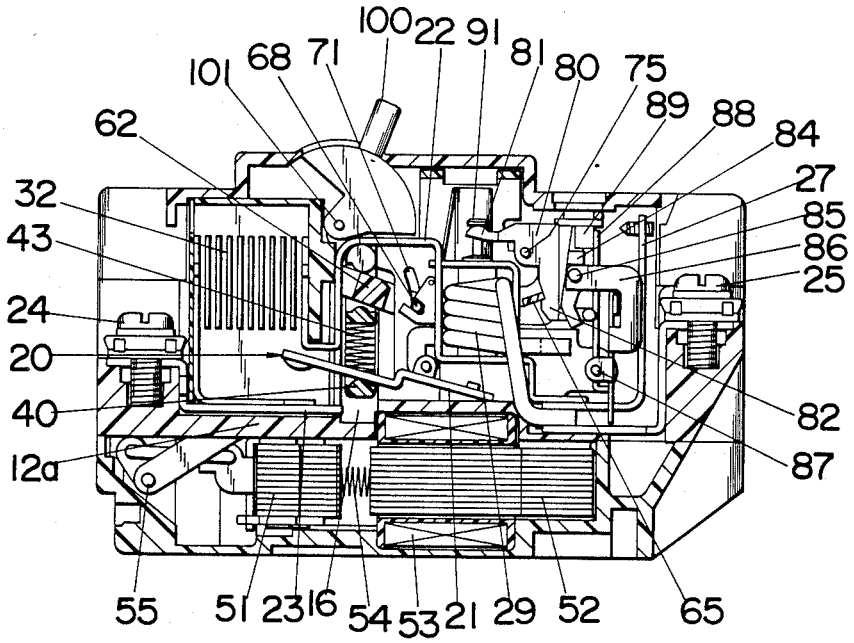
FIGS. 8 to 11 are sectional view taken along line B-B of FIG. 1, respectively showing the breaker in positions corresponding to FIGS. 4 to 7.
Figure 5:
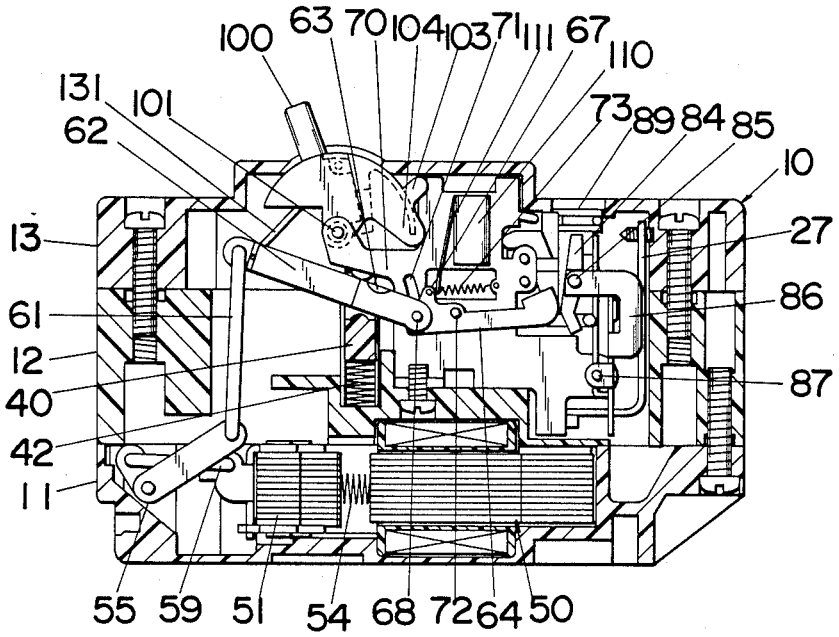
Figure 9:
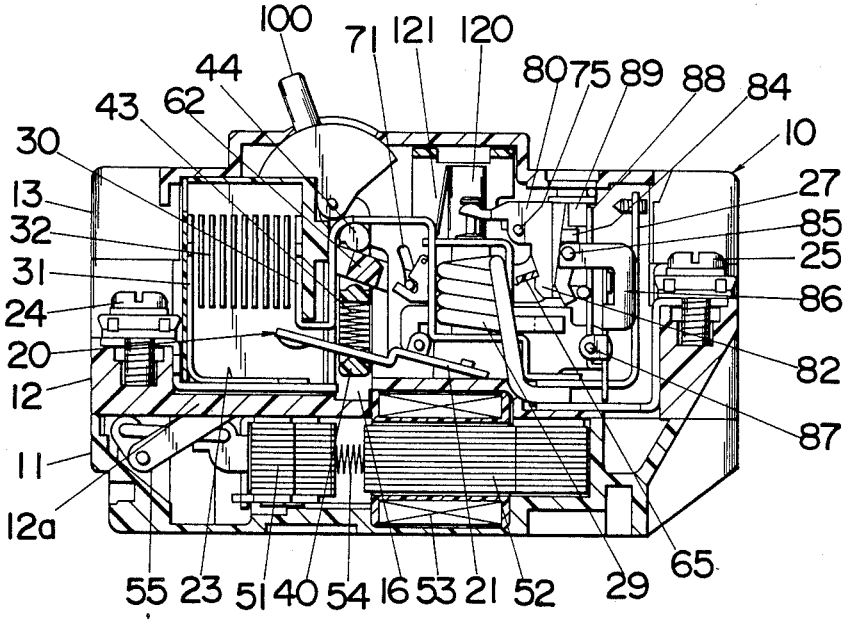
Figure 6:
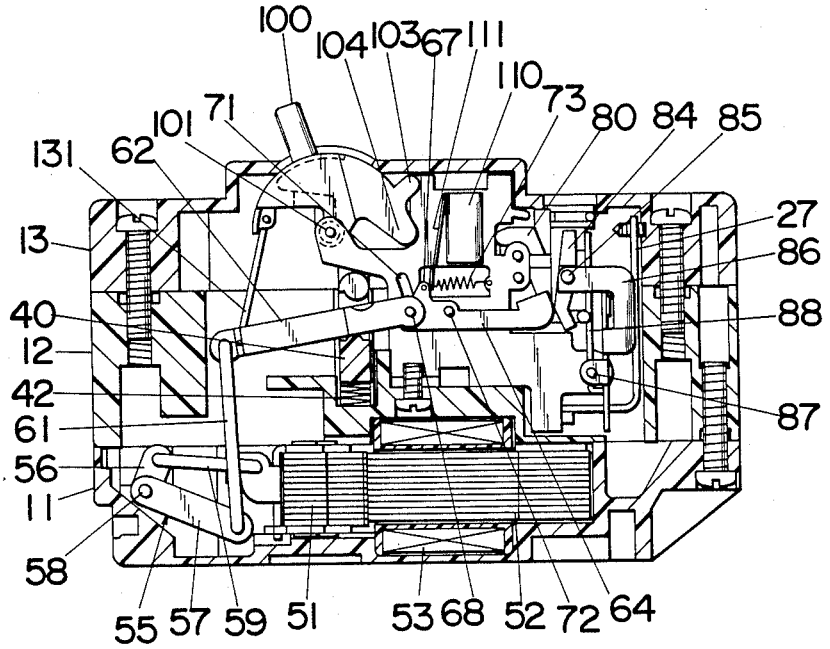
Figure 10:
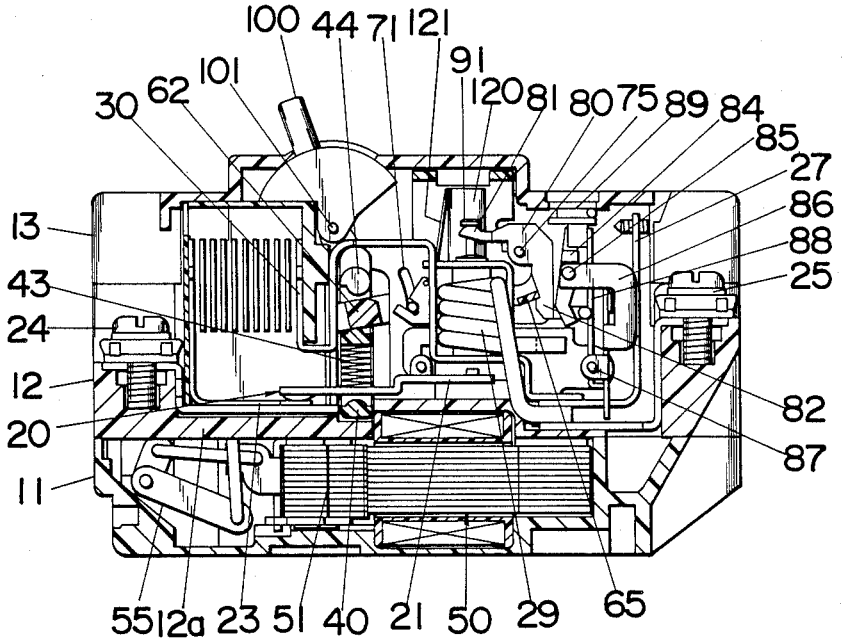

As shown in FIGS. 3 and 8, the movable contact arms 21 have their respective ends extending through three separate openings 41 in a contact holder 40 of electrically insulative material to be carried thereby and movable therewith. The contact holder 40 is received within a slot 16 extending transversely of the partitions 15 to be vertically movable and is urged upwardly for opening the contacts by a pair of release springs 42 interposed between the contact holder 40 and the bottom of the slot 16, as best shown in FIG. 4. A compression spring 43 is disposed within each opening 41 and acts on the movable contact spring 21 in the closed position of FIG. 10 in such a way as to develop a suitable contact pressure between the closed contacts. The contact holder 40 is operatively connected to the electromagnet 50 via a collapsible mechanical linkage 60 to be actuated thereby for closing and opening the power contacts 20. That is, the contact closing is made when the contact holder 40 receives a downward force from the linkage 60, as shown in FIGS. 6 and 10, while the contact opening is effected when the contact holder 40 is released from the linkage 60 to move upwardly under the bias of the release springs 42, as shown in FIGS. 4 and 8 or 5 and 9.

The electromagnet 50, which is accommodated within the top opened lower casing 11, comprises an armature 51 in the form of a movable core, an U-shaped fixed core 52, and excitation coils 53 magnetically coupled to the fixed core 52. The armature 51 is urged away from the fixed core 52 by return springs 54 interposed therebetween so that it is attracted to the fixed core 52 against the bias of the return springs 54 upon energization of the excitation coils 53. The armature 51 is connected to one end of the mechanical linkage 60 through a bell-crack comprising a rocker 55 with angularly spaced short and long arms 56 and 57. The rocker 55 is supported within the lower casing 12 by means of a pin 58 to be pivotable thereabout with the short and long arms 56 and 57 linked with the armature 51 and the mechanical linkage 60 respectively by tie members 59 and 61, whereby the horizontal movement of the armature 51 is translated into a vertical movement of the one end of the mechanical linkage 60.

Figure 7:
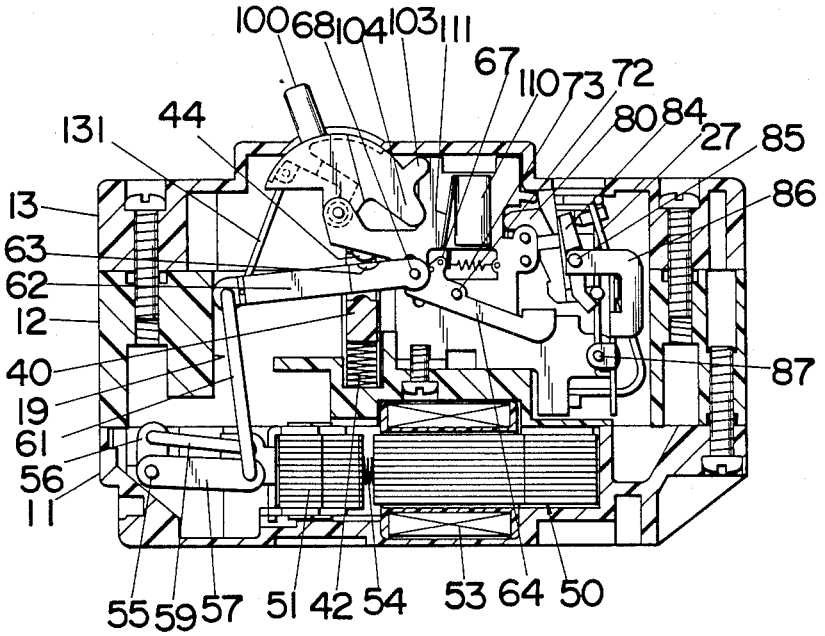
Figure 11:
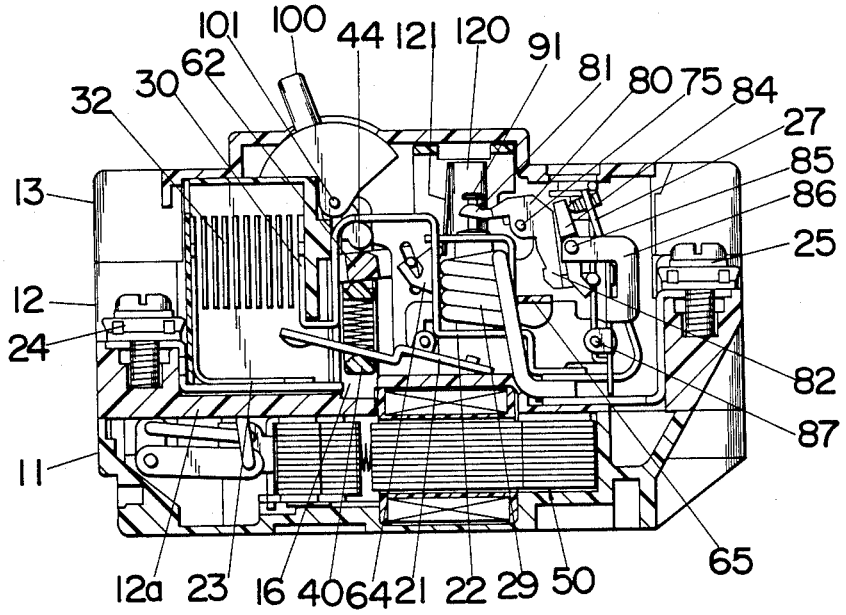
Figure 12:
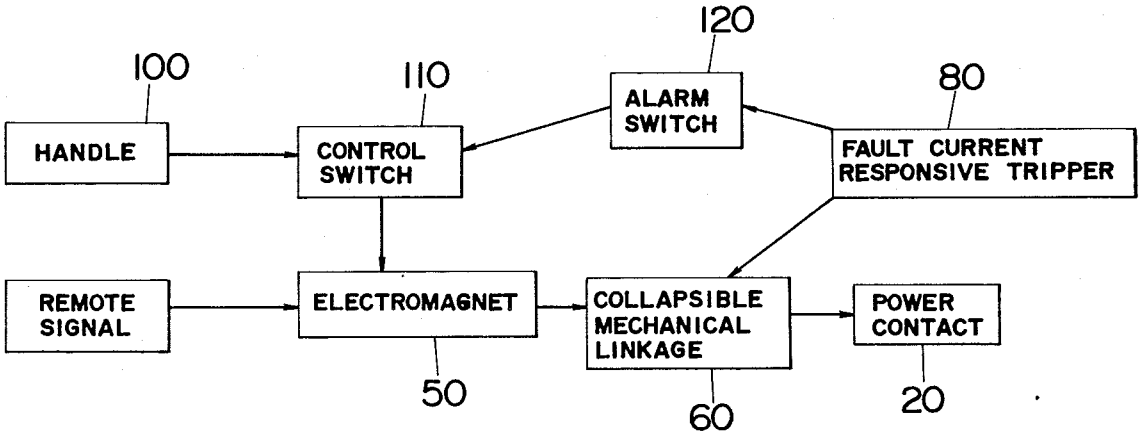
FIG. 12 is a block diagram showing the operation of the breaker.

The collapsible mechanical linkage 60 comprises a generally H-shaped actuator arm 62 movably supported on a frame 70 by means of a center pin 68 and a generally U-shaped lever 64 articulated with the actuator arm 62 by the same pin. The actuator arm 62 has its one end pivoted to the upper end of the tie member 61 for connection of the linkage 60 with the armature 51, as described previously. The other end of the actuator arm 62 is pivotally connected by the center pin 68 to one end of the lever 64 so that the actuator arm 62 and the lever 64 can pivot about the common center pin 68, respectively. The center pin 68 extends through an arcuate slot 71 in the frame 70 to be movable along the arcuate path, allowing the mechanical linkage 60 to move between an OFF-condition of FIGS. 4 and 8 (FIGS. 5 and 9) and an ON-condition of FIGS. 6 and 10. In the OFF-condition which is induced by the deenergization of the electromagnet 50, the left end of the actuator arm 62 is kept raised by the tie member 61 retained in this position by the armature 51 being in its rest position, while the center pin 68 or the right end of the actuator arm 62 is kept in the lower position within the arcuate slot 71 to keep the actuator arm 62 disengaged away from the contact holder 40, leaving the contact holder 40 to move upwardly under the bias of the release springs 42 for opening the power contacts 20, simultaneously. In the ON-condition induced by the energization of the electromagnet 50, on the other hand, the left end of the actuator arm 62 is lowered by the tie member 62 pulled downwardly by the armature 51 moving to its actuated position, causing the actuator arm 62 to pivot about the center pin 68 during which pivotal movement the contact holder 40 is forced by the actuator arm 62 to be pressed downwardly for closing the power contacts 20. The lever 64 is also pivotally supported by means of pins 72 to the frame 70 at a portion intermediate its ends and is biased by an expansion spring 73 to pivot about the pins 72 in the direction of urging the center pin 68 upwardly in the arcuate slot 71, or in the clockwise direction as seen in FIG. 4, for example. The expansion spring 73 is received in a cutout 74 in the frame 70 with its one end connected to the lever 64 adjacent the center pin 68 and with the other end to opposite end of the cutout 74. The lever 64 is engageable at its end opposite to the center pin 68 with a tripper 80 so as to be kept latched in a position of retaining the center pin 68 at the lower end of the arcuate slot 71 against the bias of the expansion spring 73. The tripper 80 is pivotally supported on the frame 70 by a pivot pin 75 and is operatively connected to a fault current sensing device so that it is actuated upon a predetermined fault current condition to unlatch the mechanical linkage 60 into a collapsed position of FIG. 7, in which the lever 64 is disengaged from the tripper 80 and is forced to pivot in the clockwise direction under the bias of the spring 73, raising the center pin 68, or the right end of the actuator arm 62 to release the contact holder 40 to open the power contacts 20.

Included in the fault current sensor device are the magnetic coil 29 and the bimetallic strip 27 which are inserted in series with the power contact 20 in each pole. Each magnetic coil 29 is magnetically coupled to a plunger 91 which comprises upper and lower members 92 and 93, and a compression spring 94 held therebetween. The plunger 91 extends through the coil 29 with its lower end directly engageable with the movable contact 21 and with the upper end engageable with each of hooks 81 formed on the tripper 80. At the opposite portion of the pivot pin 75 from the hooks 81 the tripper is formed with a latch tip 82 engageable with a notch 65 at the right end of the lever 64 for retaining the mechanical linkage 60 in a latched position, as shown in FIGS. 4, 5, and 6 (FIGS. 8, 9, and 10).

When an extreme fault current, i.e., a short-circuit current flows through in any of the coils 29, the plunger 91 is magnetically driven downwardly to firstly strike the movable contact 21 at its lower end so as to apply a contact opening impact thereto and immediately thereafter to pull the hook 81 of the tripper 80 for initiating the collapsing the mechanical linkage 60, whereby the power contact 20 is instantaneously forced to open by the contact opening impact from the plunger 91 followed by being held in the open condition due to the collapsing of the mechanical linkage 60.

The tripper 80 is also engageable with the upper end of each bimetallic strips 27 by way of a kicker flap 84 pivotally supported on the upper end of a retainer yoke 86 by a pin 85. The retainer yoke 86 is pivotally supported at a bearing 87 on the right end of the frame 70 with a spring 76 interposed between the lower extreme of the retainer yoke 86 and the frame 70 so that the retainer yoke 86 is urged in the counterclockwise direction. An upright tang 88 extends upwardly from the lower end of the retainer yoke 86 so as to be engageable against an adjusting member 89 which act as a stop for the retainer yoke 86. The adjusting member 89 is provided in the form of an eccentric shaft rotatably held in the cover plate 13 so as to adjust the position of the retainer yoke 86 and the kicker flap 84 carried thereby in relation to the upper ends of the bimetallic strips 27, whereby enabling to adjust a response voltage at which the tripping or collapsing of the mechanical linkage 60 is induced by the bimetallic deflection.

It should be noted at this time that the actuator arm 62 of the mechanical linkage 60 is formed with catches 63 engageable with a horizontal bar 44 on the upper end of the contact holder 40. When the mechanical linkage 60 is collapsed to release the actuator arm 62 to move upwardly in response to the fault current condition, the catches 63 are engaged with the horizontal bar 44 to thereby lift the contact holder 40 during the upward movement of the actuator arm 62 for forcibly opening the power contacts 20, independently of the biasing force of the release spring 42. This enables the reliable contact separation even if the release springs 42 alone fail to release the contact holder 40 upwardly due to, for example, a contact welding.

After the mechanical linkage 60 is unlatched into the collapsed position by the tripper 80 resulting either from the plunger 91 or the bimetallic strip 27, the tripper 80 is returned to its normal position by means of a spring 83*a* interposed between a portion 83 of the tripper 80 and a portion 77 of the frame 70 so as to be ready for being reset to the latched position. Since the lever 64 of the mechanical linkage 60 is articulated to the armature 51 of the electromagnet 50, it could be reset to the latched position by deenergizing the electromagnet 50. In the illustrated embodiment, the resetting by the electromagnet 50 is inhibited and allowed only by the manipulation of the manual handle 100, as described hereinafter.

The manual handle 100 is supported on the frame 70 by means of a pivot pin 101 with an over-center spring 102 connected between the handle 100 and the frame 70 so as to pivotable about a pivot pin 101 between an ON-position and an OFF-position in an over-center manner. A nose 103 projects on the handle 100 for actuating a control switch 110 held on the frame 70 as best seen in FIG. 2. The control switch 110 is a normally closed miniature switch with its actuator 111 in abutment with the nose 103 and is adapted to be connected in circuit with the excitation coil 53 for controlling to open and close the main contacts 20 by way of the electromagnet 50. The handle 100 is mechanically isolated from the mechanical linkage 60 as far as the latter is moved between the OFF-condition of FIGS. 4 and 8 (FIGS. 5 and 9) and the ON-condition of FIGS. 6 and 10, and is only engageable with the mechanical linkage 60 after being collapsed for the purpose of resetting the same by the manipulation of the handle 100. To this end, the handle 100 is formed with a reset lever 104 which engages with the actuator arm 62 of the collapsed mechanical linkage 60 when the handle 100 is moved from its ON-position of FIG. 7 to OFF-position, during which movement the reset lever 104 pushes the actuator arm 102 downwardly to pivot about the point of connection with the tie member 61 to consequently lower the center pin 68 at the right end, whereby pivoting the lever 64 about the pin 72 in the counterclockwise direction against the bias of the spring 73 for relatching the lever 64 to the tripper 80. It should be noted at this point that upon the collapsing of the mechanical linkage 60, the left end of the actuator arm 62 comes into engaged with a stop surface 19 on the inner wall of the upper casing 12 to be retained thereby at a position of FIG. 7, preventing the left end of the actuator arm 62 from being further raised in response to the subsequent deenergization of the electromagnet 50. Thus, the mechanical linkage 60 is prohibited from being reset to the latched position by the electromagnet 50 and is only allowed to be reset by the manipulation of the handle 100 in the manner as explained in the above.

Also held on the frame 70 opposite to the control switch 110 is an alarm switch 120 which is in series circuit with the control switch 110 and is actuated by the mechanical linkage 60 tripping into the collapsed position. The alarm switch 120 is a normally closed switch having an actuator 121 in abutment with a projection 67 at the left end of the lever 64 of the mechanical linkage 60, as seen in FIGS. 4 to 7, to be opened when the actuator 121 is pressed at the projection 67 by the lever 64 being unlatched form the tripper 80. Consequently, when the breaker is utilized to electrically connect the alarm switch 120 in series circuit relation with the electromagnet 50 in the control circuit, the electromagnet 50 responds also to the fault current condition for acting to open the power contacts 20 by actuating the armature 50, independently of the tripping of the mechanical linkage 60 by the tripper 80, providing a double circuit interrupting effect by the tripping of the mechanical linkage 60 and the deenergization of the electromagnet 50. In such control mode, the above scheme of inhibiting the resetting of the mechanical linkage 60 by the electromagnet 50 is particular advantageous in a sense to avoid an unintentional contact closing by the electromagnet 50 while leaving the cause of fault current unfixed. Otherwise, the resetting would result automatically by the deenergization of the electromagnet 50 which is induced by the opening of the alarm switch 120 in response to the tripping of the mechanical linkage 60.

Figure 14:
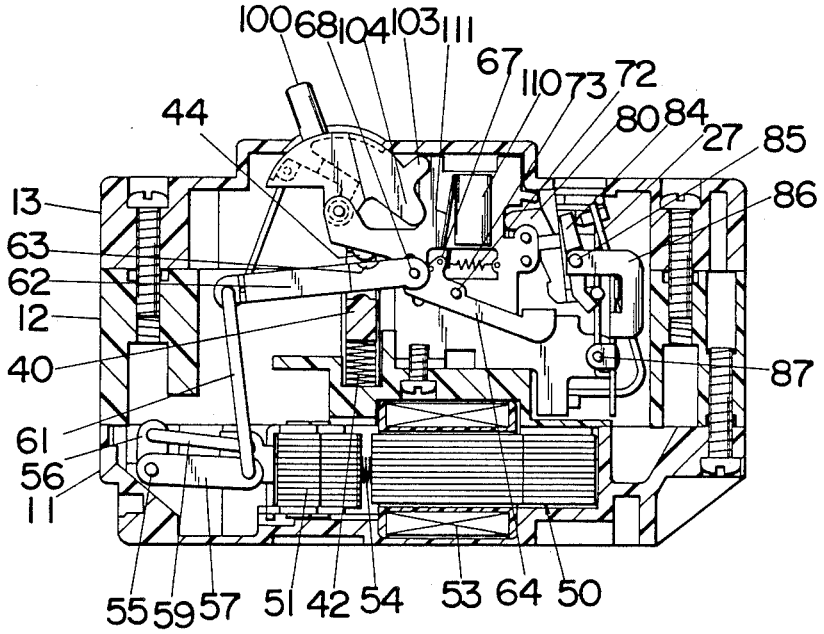
FIG. 14 is a sectional view, similar to FIG. 7 but showing a modification of the above embodiment.

However, when the breaker is required to be reset by the deenergization of the electromagnet 50 in a remote control manner, such automatic resetting by the electromagnet 50 can be easily obtained simply by removing the stop surface 19, as shown in FIG. 14 which is a modification of the present invention. In such control mode, the electromagnet 50 or the excitation coils 53 may be electrically connected in parallel relation with the series combination of the control switch 110 and the alarm switch 120.

Cooperative with and operatively connected to the mechanical linkage 60 is an indicator 130 with three markings (not seen) respectively indicating ON-condition, OFF-condition, and tripped OFF condition. The indicator 130 is pivotally supported to the common pivot axis 101 of the manual handle 100 in side by side relation therewith so that one of the markings can be viewed through a window 18 in the cover plate 13 depending upon the condition of the power contacts 20. That is, the indicator 130 has its one end about the pivot axis 101 interlocked through a link 131 to the left end of the actuator arm 62 which assumes different vertical positions depending upon the OFF-condition (FIGS. 4 and 5), ON-condition (FIG. 6), and tripped OFF-condition (FIG. 7), so that the indicator 130 is pivoted to indicate one of the three markings depending upon the conditions of the mechanical linkage 60. On the other hand, the manual handle 100 is also provided with two markings respectively indicating the handle positions, for example, "OFF" indicating to render the power contacts 20 to be kept opened irrespective of the electromagnet operation and "REMOTE" indicating to render the power contacts 20 to be remotely controlled by the electromagnet 50, one of the markings is viewed through a window 17 in the cover plate 13. The marking on the handle 100 is cooperative with that on the indicator 130 to show an exact operating mode of the breaker or the load for easy understanding of load conditions.

An auxiliary switch 140 is received in the lower casing 11 adapted in use to be connected in the control circuit with the electromagnet 50. The auxiliary switch 140 has its actuator 141 in abutment with the armature 51 of the electromagnet 50 to be closed and opened depending upon the armature position, which is useful in energizing and deenergizing the electromagnet 50 in a remote control manner by the use of a rest switch 150 and a reset switch 160 both of a momentary type, as shown in FIG. 13.

Figure 13:
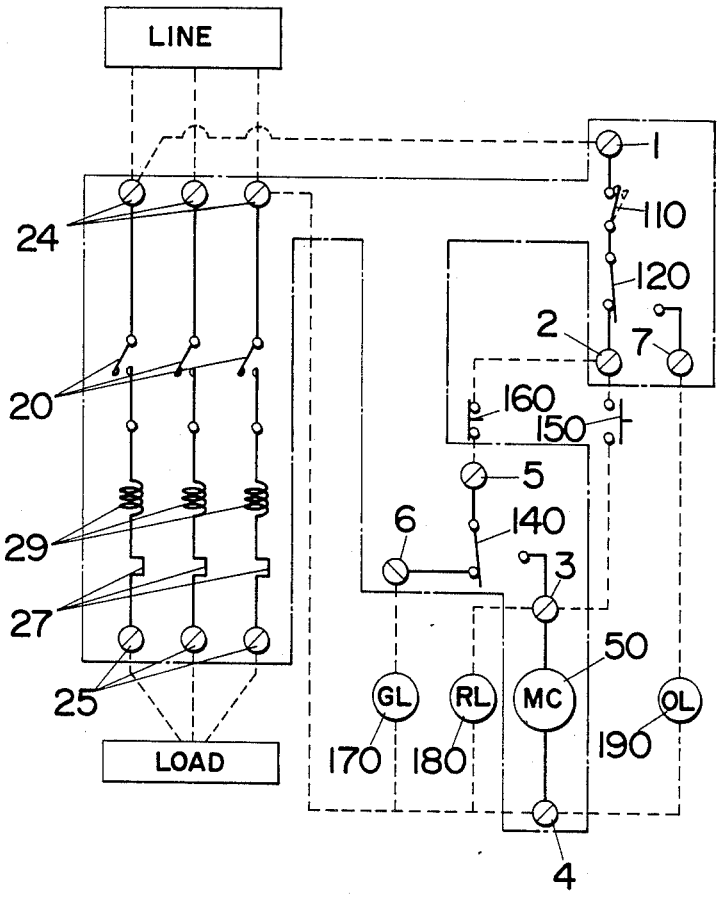
FIG. 13 is a schematic circuit diagram showing one application of the breaker in a power circuit.

FIG. 13 shows a wiring diagram of the circuit breaker in a general application use in which the internal and external wirings are shown respectively in solid and dotted lines with corresponding control terminals, and in which the breaker components are encircled by a phantom line. These control terminals are arranged in arrays on the opposite ends of the upper casing 12, as shown in FIG. 1. As illustrated in FIG. 13, control switch 110 and the alarm switch 120 is connected internally between first and second control terminals 1 and 2, while the electromagnet 50 is between third and fourth control terminals 3 and 4. The auxiliary switch 140 is also internally connected between third and fifth control terminals 3 and 5. First and fourth control terminals 1 and 4 are adapted to be respectively connected to two of the line terminals 24 so that the power source common to the load can energize the control circuit comprising electromagnet 50, the control switch 110, alarm switch 120, auxiliary switch 140, set switch 150, and reset switch 160. The set switch 150 is a normally open switch connected between second and third control terminals 2 and 3 in parallel relation with the series circuit of the reset switch 160 of normally closed type and the auxiliary switch 140. The auxiliary switch 140 is provided as a three-way switch with a common contact connected to the control switch 110 through fifth control terminal 5, reset switch 160, second control terminal 2, and alarm switch 120, and with a normally open contact connected through third control terminal 3 to the electromagnet 50.

In operation, when the control switch 110 is kept closed by the manipulation of the handle 100 and the set switch 150 is pressed at the remote station to energize the electromagnet 50 for closing the power contacts 20, the auxiliary switch 140 is switched over in response to the armature 51 movement to conduct the bypass line between second and third terminals 2 and 3 through the normally closed reset switch 160, maintaining the electromagnet 50 energized for keeping the power contacts 20 closed until the reset switch 160 is opened. The normally closed contact of the auxiliary switch 140 is connected to a sixth control terminal 6 which is adapted in use to turn on and off a green monitor lamp 170, for example, connected between fourth and sixth control terminals 4 and 6. Another monitor lamp 180, for example, of red color may be likewise connected between third and fourth control terminals 3 and 4 for indicating condition of the electromagnet 50 connected in parallel therewith. The alarm switch 120 is also provided in the form of a three-way switch with its common contact connected to the control switch 110 and with its normally closed contact to second control terminal 2. The normally open contact of the alarm switch 120 is connected to a seventh control terminal 7 which can be cooperative with fourth control terminal 4 to insert therebetween an alarm lamp 190 so as to turn on the same for indicating the occurrence of the fault current condition as a result of the tripping operation of the mechanical linkage 20. Although, the breaker of the present invention is explained in the above to be remotely controlled by the combination of the set and reset switches 150 and 160, it is equally possible to use a single remote switch of maintained type between second and third control terminals 2 and 3. Further, the breaker of the present invention may be utilized in another control mode in which, for example, a remote switch for energizing the electromagnet 50 is connected in parallel relation with the control switch 110 to provide a logical "OR" combination for closing the power contacts 20. Still other control modes can be obtained by wiring the suitable control terminals as necessary.

What is claimed is:

1. A remotely controllable circuit breaker comprising:

power contact means adapted to be connected in a power circuit for managing an electric load;

a collapsible mechanical linkage connected to close and open said power contact means;

an electromagnet having excitation coil means and an armature, said excitation coil means connected in a control circuit to be energized and deenergized upon receiving a remote control signal, said armature being movable in response to the energization and deenergization of said excitation coil means between an actuated position of driving said power contact means through said mechanical linkage into the closed condition and a rest position of driving said power contact means through said mechanical linkage into the open condition;

a control switch connected in said control circuit with said excitation coil;

a manual handle movable between an ON-position and OFF-position and connected to close said control switch when it is moved to the ON-position and open the same when it is moved to the OFF-position, fault current sensing means for sensing a fault current passing through said main contact means;

tripper means cooperative with said fault current sensing means and operatively connected to said collapsible mechanical linkage for directly actuating the latter independently of said electromagnet to unlatch and release the same into a collapsed position of opening said power contact means from a latched position of keeping the power contact means closed in response to a fault current condition sensed by said fault current sensing means; and said manual handle being mechanically isolated from said collapsible mechanical linkage as far as the latter is moved to open and close said power contact means while kept in said latched position.

2. A remotely controllable circuit breaker as set forth in claim 1, wherein said armature is biased by return spring means toward said rest position and is connected to drive said mechanical linkage into said actuated position against the bias of said return spring means in response to the energization of said excitation coil means.

3. A remotely controllable circuit breaker as set forth in claim 1, wherein said power contact means cooperative with release spring means to be normally urged thereby into its open condition, said power contact means operatively connected to said mechanical linkage so that said release spring means act to add a force thereto for moving said mechanical linkage into the collapsed position upon unlatching of said mechanical linkage by said tripper means.

4. A remotely controllable circuit breaker as set forth in claim 2, further including a normally closed alarm switch which is inserted in series circuit with said control switch, said alarm switch being operatively connected to said tripper means such that it is caused to open in response to the tripping operation of said mechanical linkage for deenergizing said electromagnet, whereby effecting the opening of said power contact means by means of said electromagnet in addition to said mechanical linkage.

5. A remotely controllable circuit breaker as set forth in claim 2, wherein said control switch is connected in circuit within a breaker housing between first and second terminals formed on said breaker housing, while said excitation coil is connected in circuit within said breaker housing between third and fourth terminals on said breaker housing, said first and fourth terminals being adapted in use to be connected between a voltage source for energization of said control circuit, and second and third terminals being adapted in use to have an external switch of maintained type inserted therebetween, establishing the series circuit connection of said control switch, said excitation coil.

6. A remotely controllable circuit breaker as set forth in claim 5, further including an auxiliary switch which is actuatable by said armature to be kept opened while the armature is in the rest position and to be closed when the armature is moved to said actuated position, said auxiliary switch being connected in said control circuit between said third terminal and a fifth terminal, wherein said second and third terminals are adapted in use to have an external set switch of momentary type inserted therebetween, and wherein said second and fifth terminals are adapted in use to have an external reset switch of momentary type inserted therebetween so that said set switch is connected in parallel relation with the series combination of said reset switch and said auxiliary switch between said second and third terminals, whereby said control circuit is energized by closing said set switch and said control switch and is kept energized by said auxiliary switch being closed in response to the energization of said electromagnet until either of said reset switch or said control switch is opened.

7. A remotely controllable circuit breaker as set forth in claim 1, wherein said handle includes a reset lever which is engageable with said mechanical linkage being moved into its collapsed position such that the reset lever transmits to said mechanical linkage a restoring force of moving it back to said latched position as said handle is moved from the ON-position to the OFF-position, and wherein means are included to inhibit said armature from driving said mechanical linkage to move back to the latched position from the collapsed position during its return stroke from the actuated position to the rest position.

8. A remotely controllable circuit breaker as set forth in claim 1, wherein said armature is linked to said collapsible mechanical linkage such that the mechanical linkage can be reset to said latched position from the collapsed position as the armature is returned from said actuated position back to said reset position.

9. A remotely controllable circuit breaker as set forth in claim 1, wherein said fault current sensing means includes a magnetic coil inserted in series with said power contact means and a plunger electromagnetically coupled thereto, said plunger having a first end engageable with said tripper means and a second end engageable directly with said power contact means without any intervening linkage therebetween, and said plunger driven by said magnetic coil seeing an overcurrent of a predetermined level flowing therethrough to firstly strike said power contact means to apply a contact opening impact thereto at said first end and subsequently actuate said tripper means at said second end to unlatch said mechanical linkage into its collapsed position.

10. A remotely controllable circuit breaker as set forth in claim 1, wherein said power contact means comprises a fixed contact and a movable contact carried by a displaceable contact holder to be movable therewith, said contact holder being cooperative with said release spring means to urge said movable contact away from said fixed contact and engageable with said mechanical linkage in such a manner that said contact holder is pulled in the direction of disengaging said movable contact from said fixed contact by said mechanical linkage moving from the latched position to the collapsed position.

11. A remotely controllable multipole circuit breaker provided with individual power circuits for more than one pole which comprises:

a plurality of power contacts each connected in each of said power circuits for managing an electric load, said power contacts being interlocked to be movable together between a closed condition and an open condition and cooperative with spring means to be normally urged thereby into said open condition;

a collapsible mechanical linkage connected to close and open said power contacts simultaneously;

an electromagnet having excitation coil means and an armature, said excitation coil means connected in a control circuit to be energized and deenergized upon receiving a remote control signal, said armature being movable in response to the energization and deenergization of said excitation coil means between an actuated position of driving said power contacts through said mechanical linkage into the closed condition and a rest position of driving said power contacts through said mechanical linkage into the open condition;

a control switch connected in series with said excitation coil in said control circuit;

a manual handle movable between an ON-position and OFF-position and connected to close said control switch when it is moved to the ON-position and open the same when it is moved to the OFF-position;

fault current sensing means for sensing a fault current passing through said main contact;

tripper means cooperative with said fault current sensing means and operatively connected to said collapsible mechanical linkage for directly actuating the latter independently of said electromagnetic to move said linkage into a collapsed position of opening said power contacts from a latched position of keeping the power contacts closed in response to a fault current condition sensed by said fault current sensing means;

said manual handle being mechanically isolated from said collapsible mechanical linkage as far as the latter is moved to open and close said power contact means while kept in said latched position; and a breaker housing the interior of which is divided by a horizontal wall into a lower compartment for receiving therein said electromagnet and an upper compartment for receiving therein said power contacts, said mechanical linkage, and said handle;

the portion of said upper compartments further divided by upright wall means into individual pole chambers each receiving each of said power contacts, said upright wall means being formed with a hole through which extends tie rod means for linkage between said armature in the lower compartment and said mechanical linkage in the upper compartment.

12. A remotely controllable multipole circuit breaker as set forth in claim 11, further including a normally closed alarm switch which is inserted in series circuit between said control switch and said excitation coil means, said alarm switch being operatively connected to said tripper means such that it is caused to open in response to the tripping operation of said mechanical linkage for deenergizing said electromagnet, whereby effecting the opening of said power contact means by means of said electromagnet in addition to said mechanical linkage.

* * * * *

UNITED STATES PATENT AND TRADEMARK OFFICE

CERTIFICATE OF CORRECTION

PATENT NO. : 4,879,535

DATED : November 7, 1989

INVENTOR(S) : MORI et al

It is certified that error appears in the above-identified patent and that said Letters Patent is hereby corrected as shown below:

On the cover page, after Item [22], add the following:

--[30] Foreign Application Priority Data

May 26, 1987 [JP] Japan.....62-129136--.

Signed and Sealed this

Twenty-eighth Day of May, 1991

*Attest:*

HARRY F. MANBECK, JR.

*Attesting Officer*

*Commissioner of Patents and Trademarks*